United States Patent [19]

Kerpers et al.

[11] Patent Number: 4,539,737

[45] Date of Patent: Sep. 10, 1985

[54] METHOD FOR INSTALLING A MOTOR-COMPRESSOR UNIT IN A COOLING DEVICE

[75] Inventors: Werner Kerpers, Bingen; Werner Bonk, Mörfelden; Dieter Röser, Lohfelden; Hans-Jürgen Führer, Gudensberg, all of Fed. Rep. of Germany

[73] Assignee: Licentia Patent-Verwaltungs-GmbH, Frankfurt am Main, Fed. Rep. of Germany

[21] Appl. No.: 610,771

[22] Filed: May 16, 1984

[30] Foreign Application Priority Data

May 20, 1983 [DE] Fed. Rep. of Germany ..... 3318448

[51] Int. Cl.[3] ..... B23P 17/00; F16M 1/00; F25D 23/00

[52] U.S. Cl. ..... 29/423; 248/671; 62/302

[58] Field of Search ..... 29/423, 464; 248/671, 248/674, 675; 62/302, 448

[56] References Cited

U.S. PATENT DOCUMENTS 3,230,733 1/1966 Rutishauser et al. ..... 62/302
3,323,625 6/1967 Webster ..... 62/302
3,516,627 6/1970 Gable et al. ..... 248/671
3,866,867 2/1975 La Rocca ..... 62/448

FOREIGN PATENT DOCUMENTS 500694 3/1954 Canada ..... 248/671

*Primary Examiner*—Howard N. Goldberg
*Assistant Examiner*—Steven Nichols
*Attorney, Agent, or Firm*—Spencer & Frank

[57] ABSTRACT

In order to permit a motor-compressor unit to be connected with the coolant circuit of a cooling device without interference from the walls of a compartment provided in the cooling device for housing the motor-compressor unit and to secure the motor-compressor unit in the compartment, the motor-compressor unit is placed at least partially outside the compartment and is pushed into the compartment and secured therein only after its coolant conduits have been connected with the coolant circuit and the electrical connections have been made. For this purpose, a mounting plate is temporarily installed in the compartment and the motor-compressor unit is loosely placed on it. After the connections have been made, the motor-compressor unit is pushed into the compartment on the mounting plate and then the mounting plate is removed. The tongues on rails secured to the motor-compressor unit are then screwed into the housing of the cooling device at the entrance to the compartment.

18 Claims, 3 Drawing Figures

METHOD FOR INSTALLING A MOTOR-COMPRESSOR UNIT IN A COOLING DEVICE

BACKGROUND OF THE INVENTION

The present invention relates to a method for installing a motor-compressor unit in a compartment in a cooling device such as a refrigerator or freezer, and more particularly to an installation method which avoids the necessity of making connections and conducting mounting procedures within the restricted confines of the compartment. The present invention also relates to a cooling device having a motor-compressor unit installed therein.

It is customary, when installing a motor-compressor unit in a rearwardly open compartment in a cooling device, to mount the unit at its final position within the compartment during a first installation step. In a further step, the conduits from the motor-compressor unit are connected to the coolant circuit of the cooling device. The necessary work, particularly soldering with a torch, is difficult to accomplish in the constricted area of the compartment and requires extreme care. This also applies to the work required to fasten the compressor in the compartment.

SUMMARY OF THE INVENTION

It is the object of the present invention to avoid the defects of the prior art by permitting free access during the assembly work which is necessary during installation of a motor-compressor unit.

This object can be attained by connecting the conduits from the motor-compressor unit to the coolant circuit of the cooling device while the motor-compressor unit is at least partially outside the compartment, and thereafter pushing the unit into the compartment. During installation of a motor-compressor unit in the manner provided by the present invention, the connections of the conduits from the unit with the coolant circuit of the cooling device can be effected outside the compartment so that free access is available during soldering. The motor-compressor unit then need merely be pushed into the compartment and secured therein. For this purpose, a mechanical plug-in connection may be provided between the motor-compressor unit (via rails) and the rear portion of the compartment, so that work within the compartment for securing the motor-compressor unit is not required. Fastening the rails at the outer portion of the compartment can then be effected in a simple manner, particularly at the edge along the opening, by means of screws. To be able to have the motor-compressor unit easily available for work in the region at the front of the compartment, a mounting plate is temporarily secured at the bottom of the compartment, which plate projects beyond the opening plane of the compartment. The motor-compressor unit is initially placed at least partially on the projecting portion of the plate so that its conduits are easily accessible. The motor-compressor unit is placed onto the mounting plate only loosely and can therefore be pushed into its final position within the compartment after the conduits have been soldered together. The mounting plate, however, is placed releasably into the compartment and can be pulled out, preferably before the motor-compressor unit is finally secured. It is then available for other assembly processes.

DESCRIPTION OF THE PREFERRED EMBODIMENTS

Figure 2:
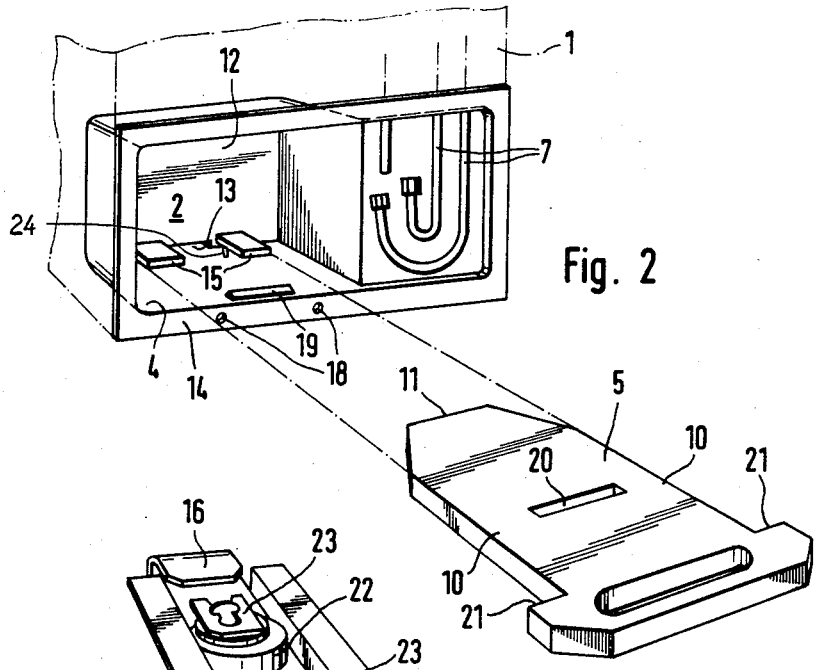
FIG. 2 is a perspective view illustrating the association of the mounting plate with the compartment.
Figure 3:
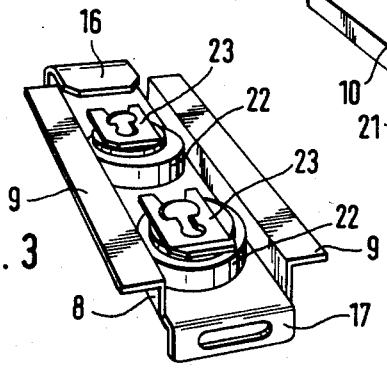
FIG. 3 is a perspective view of one of a pair of rails which are used for mounting the motor-compressor unit.
Figure 1:
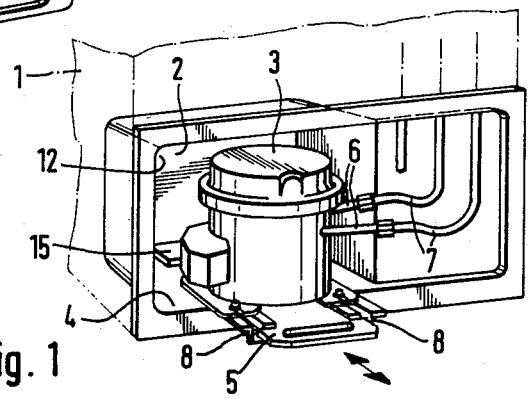
FIG. 1 is a perspective view of a portion of the back of a cooling device, and illustrates a removable mounting plate which is being used during the installation of a motor-compressor unit in a compartment in the cooling device.

In the rear of the partially illustrated housing 1 of a cooling device, particularly a household refrigerator and/or freezer, a compartment 2 is provided to accommodate a motor-compresaor unit 3. At the bottom 4 of compartment 2, there rests a mounting plate 5 which is releasably fastened in compartment 2. Mounting plate 5 projects outwardly beyond the opening plane of compartment 2, with the motor-compressor unit 3 being placed at least in part on the outwardly projecting part of the mounting plate. The conduits 6 extending from the housing of the motor-compressor unit can therefore be connected with coolant conduits 7 of the coolant circuit of the refrigerator without hindrance by the walls of compartment 2. Two parallel rails 8 having a U-shaped cross section and perpendicularly disposed flanges 9 are fixed to the underside of motor-compressor unit 3. During installation of the unit 3, flanges 9 rest loosely on longitudinal edges 10 of mounting plate 5. After establishing a connection between conduits 6 and coolant conduits 7, and possibly after performing other necessary work such as wiring the electrical connections, the motor-compressor unit can be pushed along mounting plate 5 into compartment 2, with flanges 9 in sliding engagement with longitudinal edges 10, while the coolant conduits are bent.

When mounting plate 5 is inserted in compartment 2, the end 11 of mounting plate 5 engages in a horizontally extending plug-in receptacle which is provided in the form of a pocket 13 in the rear wall 12 of compartment 2. Mounting plate 5 can therefore not tilt downwardly even if a weight is placed on the portion projecting beyond the opening edge 14 of compartment 2. However, the plug-in receptacle may also be formed by flanges 15, which are disposed at rear wall 12 in a spaced arrangement above bottom 4. In any case, flanges 15 extend laterally beyond the longitudinal edges 10 so that the tabs 16 at the inner ends of rails 8, oriented toward rear wall 12, can be accommodated beneath flanges 15. The thus configured plug-in receptacles for tabs 16 in the rear portion of compartment 2 consequently require no additional fastening means when the compressor has been pushed in. It is then sufficient to have a downwardly bent tongue 17 at the outer end of each rail 8, facing the opening of compartment 2, with this tongue extending to beyond opening edge 14 where it can be secured by means of a screw. Moreover, tabs 16 extend upward by a distance that is substantially the same as the distance between bottom 4 and flanges 15 and they are preferably secured against lateral displacement by a corresponding form-locking arrangement. Bores 18 are provided in opening edge 14 for the purpose of screwing in rails 8. Accordingly. it will be apparent a pair of screws conveniently positioned at the entrance of compartment 2 is sufficient to reliably secure motor-compressor unit 3.

The form-locking arrangement against lateral displacement of the tabs 16 is realized by short studs 24 at booth sides of every flange 15. One of the studs 24 is shown in FIG. 2. The studs 24 are arranged near the rear wall 12 of compartment 2 and engage the ends of the tabs 16 in their inserted position.

At bottom 4 of compartment 2, between the plug-in receptacle 13 and/or 15 and the opening edge 14 of compartment 2, a detent bar 19 is provided for which a corresponding opening is provided in mounting plate 5. When the mounting plate 5 is inserted in compartment 2, opening 20 comes into engagement with detent bar 19 and secures the mounting plate against inadvertent release from plug-in receptacle 13 and/or 15. After insertion of motor-compressor unit 3, mounting plate 5 is raised until the detent connection 19, 20 is released and mounting plate 5 can be pulled out. Then tongue 17 can be fastened to edge 14, for example, by a screw.

In order to retain the motor-compressor unit after it has been placed loosely on mounting plate 5, and in order to place it in its correct position, which corresponds to the length of coolant conduits 6—the length of coolant conduits 6 is determined by their intended final position—mounting plate 5 is provided with shoulders 21 at the end projecting from compartment 2. The outer faces of rails 8 abut against shoulders 21 when unit 3 is properly positioned for soldering. Rails 8 have symmetrical cross sections so that both rails can be made in the same shape. The space between the arms of rails 8 is used for the placement of vibration damping elements 22, on which are fixed the fastening feet 23 of motor-compressor unit 3.

With the foregoing background in mind, the installation process can now be summarized. Initially, mounting plate 5 is inserted into compartment 2, with end 11 being secured by pocket 13 and/or flanges 15 and with detent bar 19 engaging opening 20. Unit 3, with parallel rails 8 attached thereto, is then placed on mounting plate 5 and positioned such that the outer ends of rails 8 abut against shoulders 21. Conduits 6 are then connected to conduits 7 and any necessary wiring is accomplished. Unit 3 is then pushed into compartment 2 until tabs 16 engage flanges 15 to automatically secure the inner ends of rails 8. At this point, plate 5 can be lifted to separate detent bar 19 from opening 20, and then withdrawn from compartment 2. Thereupon the outer ends of rails 8 are secured by bolts through tongues 17 and bores 8.

It will be understood that the above description of the present invention is susceptible to various modifications, changes and adaptations, and the same are intended to be comprehended within the meaning and range of equivalents of the appended claims.

What we claim is:

1. An apparatus for mounting a motor-compressor unit in a compartment equipped with first conduits for circulating coolant, said compartment having a rear compartment wall, a compartment opening, and a compartment bottom between the compartment opening and the rear compartment wall, said motor-compressor unit having a bottom and second conduits for connection with said first conduits, comprising:

a mounting plate having a front end, a back end, and a substantially straight side between the front and back ends;

elongated rail means mounted on the bottom of the motor-compressor unit for slidably supporting the motor-compressor unit on the mounting plate, said rail means having a front end, a back end, and a side disposed between the front and back ends and configured to be slidably guided by the substantially straight side of the mounting plate;

means cooperating with the mounting plate for temporarily securing the mounting plate adjacent the compartment bottom with the back end of the mounting plate oriented toward the rear compartment wall and with the front end of the mounting plate extending through the compartment opening to support said rail means and the motor-compressor unit mounted thereon at least partially outside the compartment opening while the first and second conduits are manually connected, the back end of the rail means being oriented toward the rear compartment wall and the side of the rail means slidably engaging the substantially straight side of the mounting plate;

means extending from the rear compartment wall and spaced above the compartment bottom by a distance at least as great as the thickness of the mounting plate for automatically securing the back end of the rail means when the rail means and motor-compressor unit mounted thereon are manually slid into the compartment following the connection of the first and second conduits; and means disposed adjacent the compartment opening for securing the front end of the rail means to mount the motor-compressor unit in the compartment after the mounting plate is manually removed.

2. The apparatus of claim 1, wherein the mounting plate has two substantially straight sides that are substantially parallel to one another, and wherein the rail means comprises a pair of elongated rails each having a front end, a back end, and a side, the rails being mounted parallel to one another on the bottom of the motor-compressor unit with the sides of the rails being positioned to engage the sides of the mounting board.

3. The apparatus of claim 2, wherein said means cooperating with the mounting plate comprises pocket means provided in the rear compartment wall for permitting the back end of the mounting plate to extend beyond the rear wall.

4. The apparatus of claim 2, wherein the mounting plate has an opening therein between the front end and back end thereof and wherein said means cooperating with the mounting plate comprises a detent bar affixed to the compartment bottom between the compartment opening and the rear compartment wall at a position to engage the opening in the mounting plate.

5. The apparatus of claim 4, further comprising tabs mounted at the back ends of the rails, and wherein said means extending from the rear compartment wall comprises a pair of flanges positioned to engage the tabs.

6. The apparatus of claim 5, further comprising tongues mounted at the front ends of the rails, and wherein said means disposed adjacent the compartment opening comprises screw means for securing the tongues.

7. A method for installing a motor-compressor unit having cooling conduits in a compartment in a cooling device having cooling conduits, the compartment having an opening, comprising the steps of:

initially placing the motor-compressor unit at least partially outside of the compartment;

connecting the conduits of the motor-compressor unit with those of the cooling device while the motor-compressor unit remains at least partially outside of the compartment; and thereafter pushing the motor-compressor unit into the compartment while bending the conduits, and securing the motor-compressor unit in the compartment.

8. The method of claim 7, wherein the step of initially placing the motor-compressor unit at least partially outside of the compartment comprises the steps of:

temporarily securing a mounting plate at the bottom of the compartment, the mounting plate having a first end that projects beyond the opening and a second end disposed inside the compartment; and loosely placing the motor-compressor unit on the mounting plate so that it is at least partially disposed outside the compartment.

9. The method of claim 8, wherein the step of temporarily securing the mounting plate comprises the step of inserting the second end of the mounting plate into a horizontally extending plug-in receptacle provided in the compartment.

10. The method of claim 9, wherein said compartment has a rear wall and a bottom wall and wherein the step of inserting the second end of the mounting plate into a horizontally extending plug-in receptacle is accomplished by inserting the second end of the mounting plate beneath at least one flange that is disposed at the rear wall and above the bottom wall.

11. The method of claim 9, wherein said compartment has a rear wall and a bottom wall and wherein the step of inserting the second end of the mounting plate into a horizontally extending plug-in receptacle is accomplished by inserting the second end of the mounting plate into a pocket formed in the rear wall.

12. The method of claim 9, wherein said compartment has a rear wall and a bottom wall and wherein the step of inserting the second end of the mounting plate into a horizontally extending plug-in receptacle is accomplished by inserting the second end of the mounting plate beneath at least one flange that is disposed at the rear wall and above the bottom wall and into a pocket formed in the rear wall.

13. The method of claim 9, wherein said compartment has a rear wall and a bottom wall, said plug-in receptacle being provided at said bottom wall, and wherein the step of temporarily securing the mounting plate additionally comprises the step of inserting a detent bar provided in the bottom wall of the compartment between the rear wall and opening thereof into an opening in the mounting plate.

14. The method of claim 13, wherein said mounting plate has a parallel longitudinal edge, and further comprising the step of securing a pair of rails having flanges to the bottom of the motor-compressor unit so that the rails are substantially parallel and the flanges face each other, and wherein the step of loosely placing the motor-compressor unit on the mounting plate comprises the step of placing the motor-compressor unit on the mounting plate with the flanges of the rails resting on the longitudinal edges of the mounting plate.

15. The method of claim 14, wherein the mounting plate has shoulders adjacent the second end thereof, and wherein the step of loosely placing the motor-compressor unit on the mounting plate additionally comprises the step of placing the motor-compressor unit on the mounting plate with the rails abutting the shoulders.

16. The method of claim 15, wherein the ends of the rails facing the rear wall of the compartment are provided with tabs, and wherein the step of inserting the second end of the mounting plate into a horizontally extending plug-in receptacle is accomplished by inserting the second end of the mounting plate beneath at least one flange that is disposed at the rear wall and above the bottom wall by a distance corresponding to the positions of the tabs.

17. The method of claim 16, wherein said rails are U-shaped, and wherein the step of securing a pair of rails having parallel flanges to the motor-compressor unit is accomplished by securing the motor-compressor unit to the rails via vibration damping elements that are disposed at the bottom of the U.

18. The method of claim 17, wherein the ends of the rails not facing the rear wall of the compartment are provided with tongues, and wherein the step of thereafter pushing the motor-compressor unit into the compartment while bending the conduits, and securing the motor-compressor unit in the compartment, comprises the step of fastening the tongues to the cooling device at a position adjacent the opening of the compartment.

* * * * *